US005188743A

United States Patent [19]

King

[11] Patent Number: 5,188,743

[45] Date of Patent: Feb. 23, 1993

[54] PLATE, CHANGER, PLATE AND METHOD

[75] Inventor: Patrick D. King, Rantoul, Ill.

[73] Assignee: Flo-Con Systems, Inc., Champaign, Ill.

[21] Appl. No.: 753,387

[22] Filed: Aug. 30, 1991

Related U.S. Application Data

[63] Continuation-in-part of Ser. No. 319,410, Mar. 3, 1989, abandoned, and a continuation-in-part of Ser. No. 693,915, Apr. 29, 1991, which is a continuation of Ser. No. 494,779, Mar. 16, 1990, Pat. No. 5,052,598, and a continuation-in-part of Ser. No. 591,067, Oct. 1, 1990, Pat. No. 5,044,533.

[51] Int. Cl.[5] ..... B22D 41/38

[52] U.S. Cl. ..... 222/590; 222/600

[58] Field of Search ..... 222/590, 591, 597, 600

[56] References Cited

U.S. PATENT DOCUMENTS

| | | | |
|---|---|---|---|
| Re. 27,237 | 11/1971 | Shapland | 222/600 |
| 4,573,616 | 3/1986 | Shapland | 222/600 |
| 4,693,401 | 9/1987 | Nishimura et al. | 222/600 |

*Primary Examiner*—Scott Kastler
*Attorney, Agent, or Firm*—Jack E. Dominik

[57] ABSTRACT

A non-reversible plate having a depending tube structure with a discharge opening at the bottom in which there is a plate at the upper portion, rectangular in configuration, and which has an irregular anti-reversal collar beneath the plate portion is disclosed. Desirably the collar is elliptical in configuration and has a major axis at least seven millimeters longer than the minor axis. The longer axis is parallel with the length dimension. Another aspect of the invention is the utilization of a toggle actuated plate changing device which swings in and out of position and can only be actuated when the plate and tube intended for insertion presents the length for insertion into the valve structure. Suitable microswitch or related device is provided to permit actuation of the change actuator, but only when the plate is properly oriented for insertion. The method of the present invention includes the steps of pre-orienting and proportioning a tube or shroud having a plate at the upper portion for insertion into a plate changer assembly.

28 Claims, 6 Drawing Sheets

PLATE, CHANGER, PLATE AND METHOD

CROSS-REFERENCE TO RELATED APPLICATIONS

The present application is a continuation-in-part of application Ser. No. 319,410 filed Mar. 3, 1989 entitled "Non-Reversible Sliding Gate Valve and Method" now abandoned, and also a continuation-in-part of application Ser. No. 693,915 filed Apr. 29, 1991 and entitled "Sliding Gate Three Plate Non-Reversible System, Valve, Refractories, and Method" still pending, which in turn is a Rule 60 Continuation of application Ser. No. 494,779 filed Mar. 16, 1990 and entitled "Sliding Gate Valve, Method and Replaceable Refractories", allowed on Apr. 2, 1991, now U.S. Pat. No. 3,052,598 and a continuation-in-part of application Ser. No. 591,067 filed Oct. 1, 1990 and entitled "Clamp for Bandless Refractory and Method", issued into U.S. Letters Pat. No. 5,044,533 on Sep. 3, 1991, all by the same inventor herein.

FIELD OF THE INVENTION

The present invention relates to a mechanism, method, and apparatus for changing tubes utilized to shroud molten metal such as steel when released from a vessel by a stopper rod or similar type flow control apparatus.

SUMMARY OF THE INVENTION

Prior art type plate changers that convey plates through sequentially are well known in the art. They are exemplified by U.S. Pat. Nos. 3,352,465; 3,480,186; 3,604,603; 3,613,965; 3,618,834; 3,684,267; 3,685,705; 3,685,707; 3,727,805; 3,578,062; 3,730,401; 3,743,007; 3,749,387; 3,906,022; 4,091,861; 4,415,103; 4,545,512; 4,669,528; 4,887,748: 4,951,851; and 5,011,050. They are also exemplified in pending patent application Ser. Nos. 494,587 filed Mar. 16, 1990 and 591,067 filed Oct. 1, 1990 in United States Patent and Trademark Office. Such plates for the sequential plate changer devices have been typically square or rectangular. In such devices the length is always the dimension along the axis parallel to the axis of plate change.

The width is the other axis and may be the same as the length or may not be. Where the plate is square there is always the possibility of reversal which is undesirable. Where the plates are rectangular, there is still the possibility of reversal where the length and width dimensions do not vary sufficiently. Avoiding reversal has been the subject of attempted resolution by others, and appears in the patent literature.

SUMMARY OF THE INVENTION

The present invention involves the use of a non-reversible plate having a depending tube structure with a discharge opening at the bottom in which there is a plate at the upper portion, rectangular in configuration, and which has an irregular anti-reversal collar beneath the plate portion. Desirably the width of the plate portion exceeds the length of the plate portion by at least seven millimeters. Desirably the collar is elliptical in configuration and has a major axis at least seven millimeters longer than the minor axis. The longer axis is parallel with the length dimension. Another aspect of the invention is the utilization of a toggle actuated plate changing device which swings in and out of position and can only be actuated when the plate and tube intended for insertion presents the length for insertion into the valve structure. Suitable microswitch or related device is provided to permit actuation of the change actuator, but only when the plate is properly oriented for insertion. The method of the present invention includes the steps of pre-orienting and proportioning a tube or shroud having a plate at the upper portion for insertion into a plate changer assembly.

In view of the foregoing it is a principal object of the present invention to provide a plate change apparatus, non-reversible plates, and method to be used in conjunction with a flow controlling apparatus to allow loading access for the plates in only one direction.

A further object of the present invention is to provide a positive lockup for the actuator movement to the end that the non-reversible plates cannot be loaded improperly, cannot be moved into the working position if loaded improperly, and the change actuator remains locked in the change position upon failure in the swing circuit.

BRIEF DESCRIPTION OF THE DRAWINGS

Further objects and advantages of the present invention will become apparent as the following description proceeds, taken in conjunction with the accompanying drawings.

DESCRIPTION OF A PREFERRED EMBODIMENT

Figure 1:
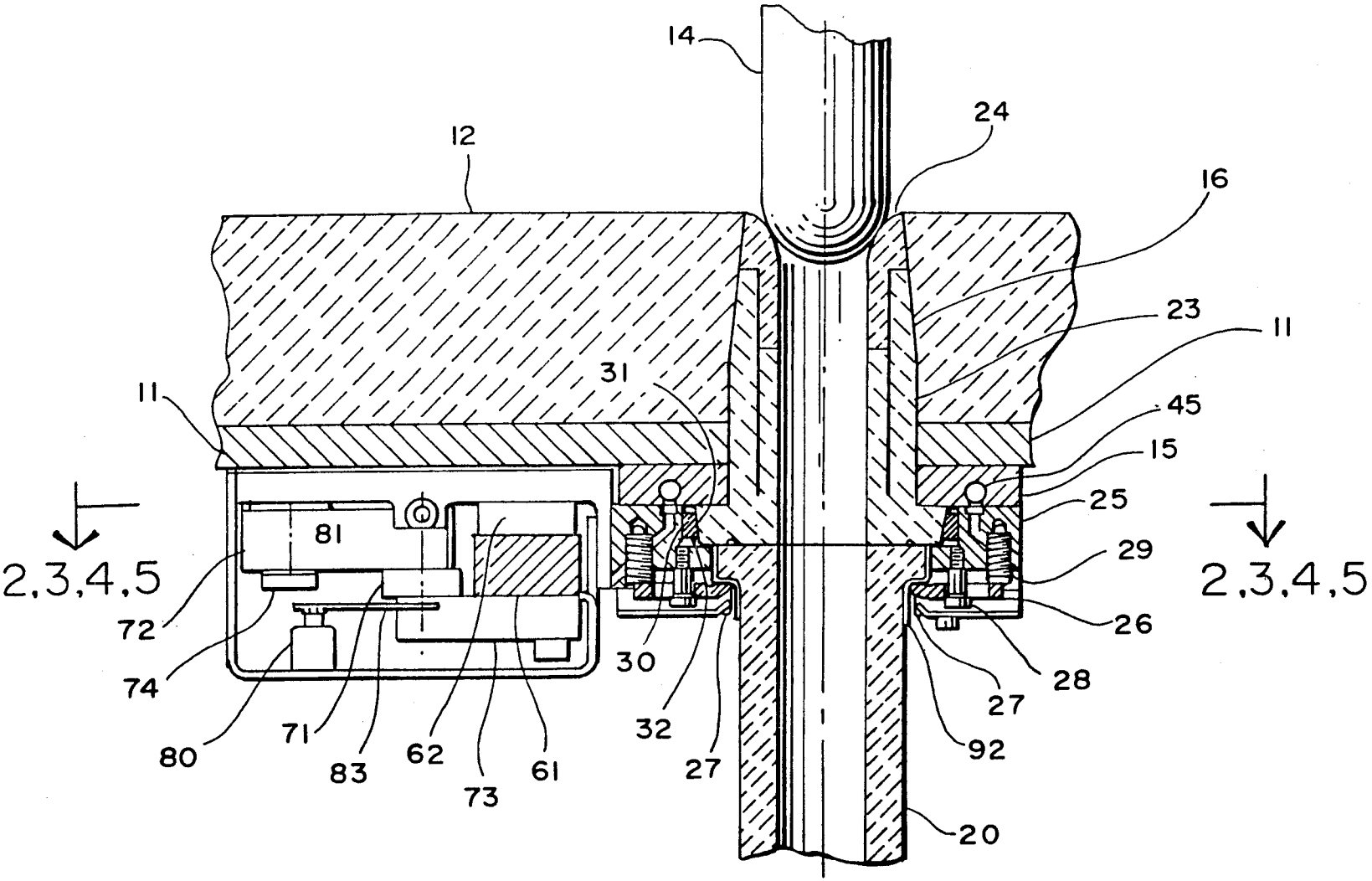
FIG. 1 is a sectional view of the illustrative non-plate and changer taken along a vertical plane.

Turning now to FIG. 1, there it will be seen that the plate changer assembly 10 is secured beneath a vessel wall 11 and penetrates the vessel lining 12. A stopper rod 14 is employed to control the teeming of the molten metal, usually steel. The assembly is secured by means of mounting plate 15 to the vessel wall 11, and nozzle plate 16 is inserted to become the communicating orifice between the stopper rod 14 and the pouring tube 20. The tube 20 is provided with a tube plate 21 at its upper portion, and which is surrounded by a metal jacket 23. Similarly, a clamp ring 30 in the form of a tapered metal ring is provided at the lower portion of the nozzle plate 16. The stopper rod seat 24 is the upper end of the nozzle plate 16.

The main frame 25 includes a plurality of rockers which engage the underneath portion of the tube plate 21. The rockers include a rocker pivot 28, and a rocker spring 29 all positioned and proportioned to urge the tube plate 21 in contact with the nozzle plate 16. A clamp ring 30 is provided to secure the nozzle plate 16 through a clamp ring taper 31 and plate taper 32 into its fixed position against the mounting plate 15. A clamp ring guide 36 secures the unit together.

Also to be noted is the rocker spring cooling manifold 45 which communicates with air to cool the rocker springs 29. A clamp ring ear 46, as shown in FIG. 2, cooperates with the clamp ring key 48 to secure the nozzle plate 16 in position with mounting bolts 50 securing the main frame 25 to the mounting plate 15.

Figure 2:
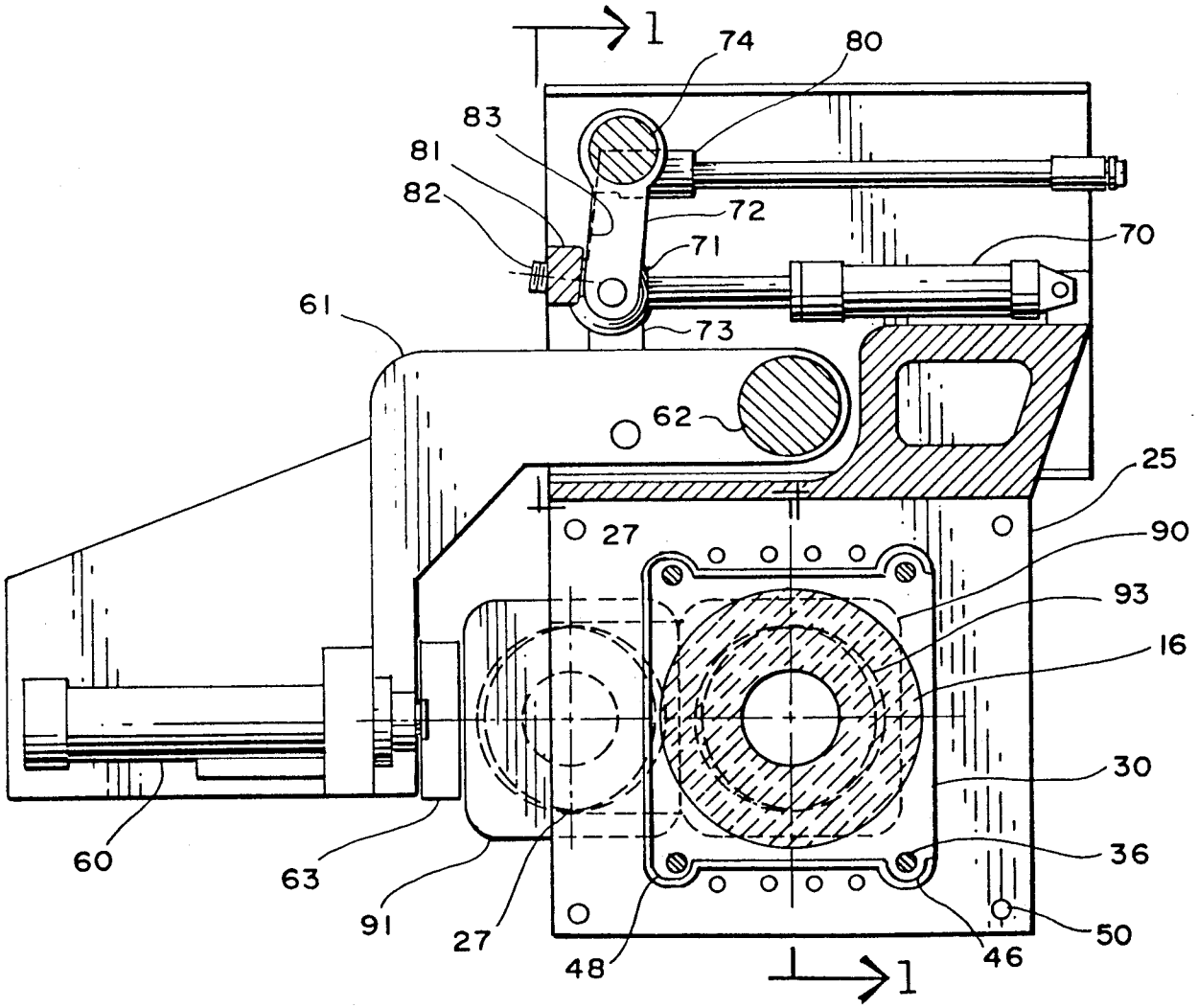
FIG. 2 is a plan view section taken along a horizontal plane of the non-reversible plate changer of FIG. 1 essentially along section lines 2—2 of FIG. 1.

The plate change actuator is best understood by back and forth reference to FIGS. 1 and 2. It will be seen that the actuator mounting arm 61 operates about an actuator arm pivot 62 which is mounted in the upper portion of the main frame 25. A link connection 71 couples the anchor link 72, the drag link 73, and provides the connection to the swing cylinder 70. The actuator 60 is secured to the end of the actuator mounting arm 61 and actuates the pusher 63. The anchor link 72 is anchored by anchor link pivot 74 which, in turn, is bolted to the frame 25 and provides the anchor point that causes the swinging when the swing cylinder 70 (see FIG. 2) is retracted. A stop mount 81 is formed as an integral part of the upper portion of the main frame 25. The stop mount carries stop screw 82 which is engaged by anchor link 72 in the locked position. Importantly a micro switch 80 or a comparable device is provided with a micro switch arm 83. The micro switch arm 83 is engaged by the anchor link 72 as it passes over center, thereby closing the internal switch and forming a permissive circuit for the plate change actuator 60.

More specifically as shown in FIG. 2, the plate change actuator 60 is shown in the locked position. There it will be seen that the anchor link 72 and drag link 73 are over center, and anchor link 72 is against the stop screw 82, which provides alignment adjustment for the plate change actuator 60. As shown, the microswitch arm 83 has been activated by the anchor link 72 and the microswitch internal switch is in the closed position allowing the plate change actuation circuitry to be in a permissive mode for plate change. The ready plate 91 is in the proper orientation adjacent the working plate 90 and the anti-reversal enlargement 93 does not interfere with the loading rails 27. The loading rails 27 are proportioned so that they will pass the short axis dimension of the lower boss 94 but not the long axis dimension. The loading rails 27 are proportioned with regard to the anti- reversal enlargement 93, particularly as shown in FIGS. 6–9 which anti-reversal enlargement can be employed irrespective of whether the plate is square or rectangular. It is further employed as a backup in the event the plates are rectangular since, when the difference between length and width is less than seven millimeters, reversal could still result.

Figure 3:
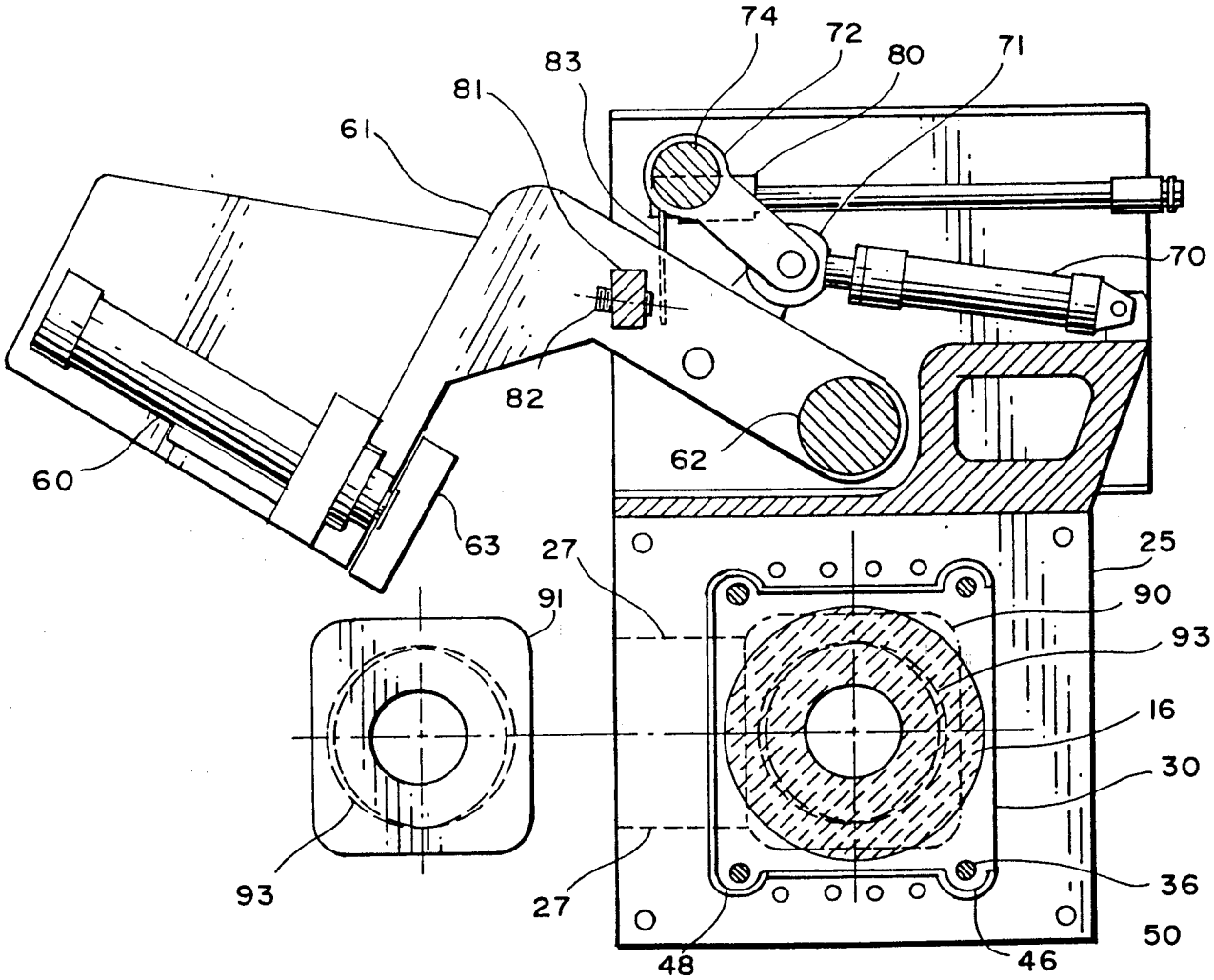
FIG. 3 is a view similar to that of FIG. 2 showing the change mechanism swung out of position to permit inserting a ready plate for loading taken along section line 3—3 of FIG. 1.

FIG. 3 shows the swing cylinder 70 in the retracted position causing the anchor link 72 to pivot about anchor link pivot 74 and consequently pulling drag link 73 and actuator mounting arm 61 to rotate at positions which moves the plate change actuator 60 into a loading position which allows access for loading ready plate 91 into the plate changer.

Figure 4:
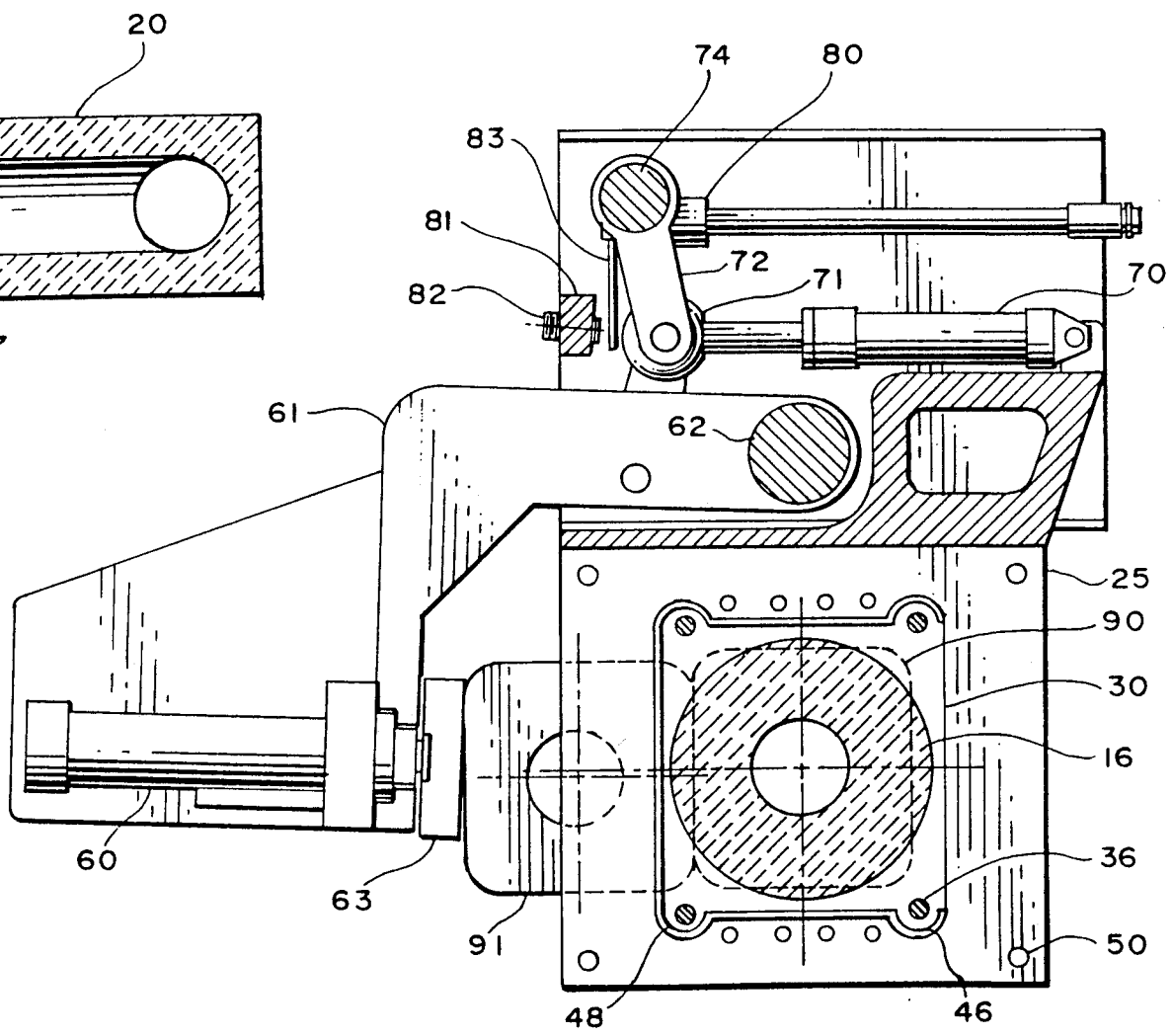
FIG. 4 is a plan view taken along a horizontal plane the same as FIGS. 2 and 3 showing the incoming plate loaded incorrectly and the plate change actuator unable to be locked into the plate change position essentially as taken along section line 4—4 of FIG. 1.
Figure 5:
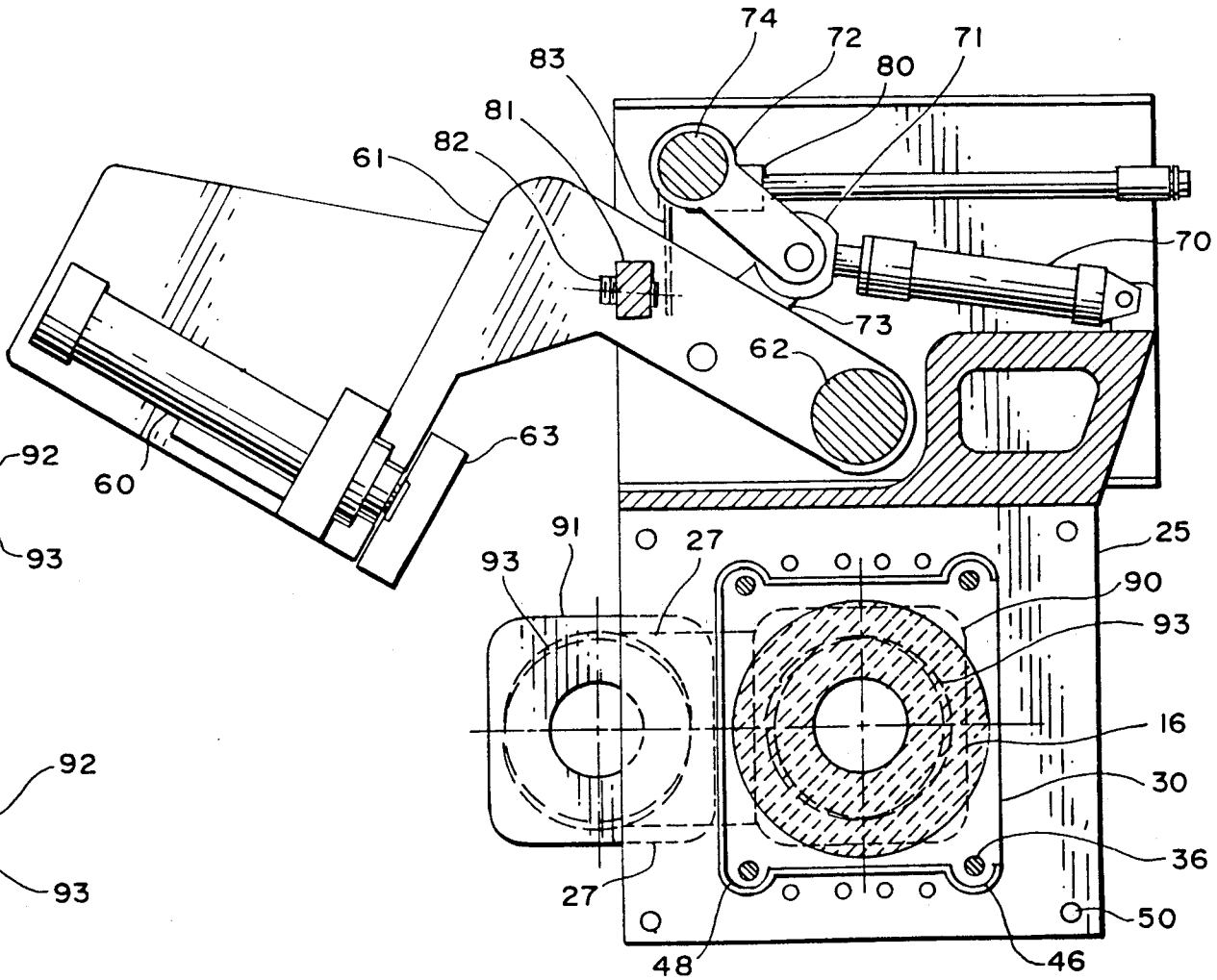
FIG. 5 is a further view comparable to FIGS. 3 and 4 showing the plate change actuator in the loading position and the plate reversed unable to be loaded.

Turning now to FIG. 4, a further view shows the ready plate 91 loaded incorrectly into the changer apparatus 10. The width is greater than the length which causes interference between the pusher 63 and the ready plate 91 when the plate change actuator 60 is attempted to be locked into the plate change position, thereby stalling swing cylinder 70 and preventing the pivot link 72 from actuating the microswitch arm 83. In this configuration the actuator circuit cannot be energized and hence the changing of an incorrectly loaded plate into the working position is precluded. A differential of 10 millimeters of the width greater than the length is sufficient to prevent lock-up of the linkage, thereby, preventing the permissive signal to allow the insertion of the incorrectly loaded plate into the working position. On the other hand, if the differential is less than ten millimeters, the enlarged anti-reversal section shown in FIG. 3 as a depending elliptical collar 93 covers that situation. More particularly, FIG. 5 is a sectional plan view showing the plate change actuator 60 in a loading position to allow loading of the ready plate 91 which is shown reversed. Here it can be seen that the anti-reversal enlargement 93 interferes with the loading rails 27 which prevents reversed loading of the ready plate 91.

Figure 7:
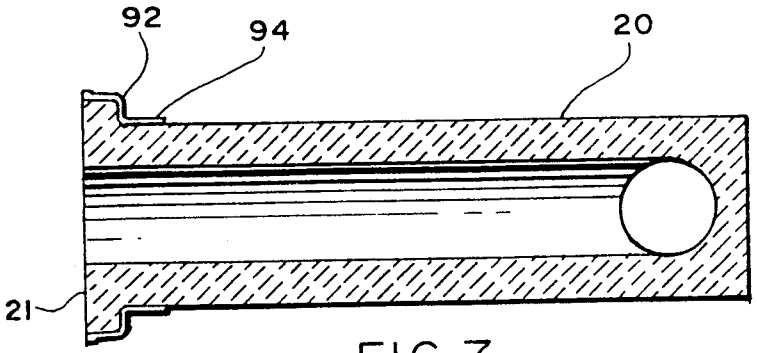
FIG. 7 is a vertical section of the plate and depending tube taken along section line 7—7 of FIG. 6.
Figure 6:
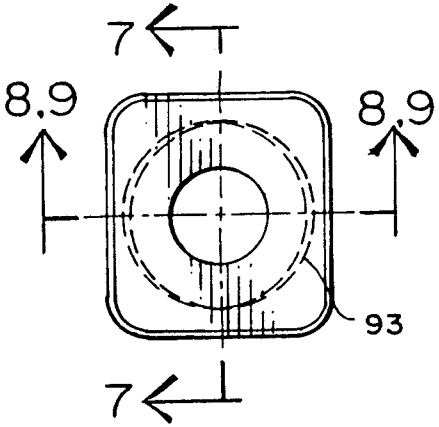
FIG. 6 is a plan view of the plate.

In FIG. 6 it will be seen that the enlargement 93 forms an elliptical collar around the otherwise circular cross-section of the boss 94 that surrounds the upper section of depending tube 20. FIG. 7 shows a section across the width of the tube plate 21 showing the small dimension lower boss 94 beneath the metal encasement 92 of the upper portion of the tube plate 21.

Figure 8:
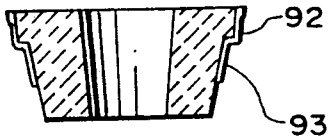
FIG. 8 is a section taken along line 8—8 of FIG. 6, but showing a drain.
Figure 9:
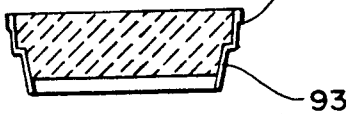
FIG. 9 is a section taken along section line 9—9 of FIG. 6 but showing a blank.

FIG. 8 discloses a cross-section across the length of the plate with the plate being applied as a drain plate, and having a metal encasement 92 and anti-reversal enlargement 93. Finally, FIG. 9 is a section across the length of the plate showing the plate used as a blank or imperforate plate, again showing the metal encasement 92 and the anti-reversal enlargement 93.

Figure 10:
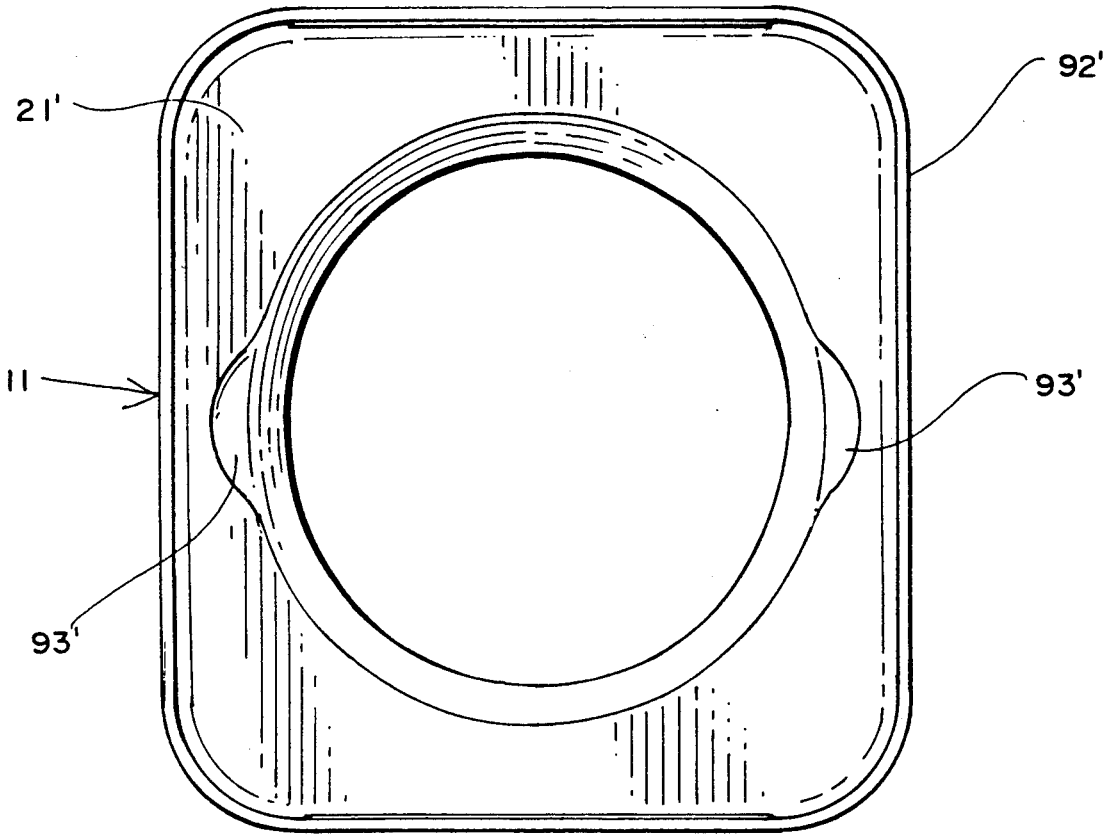
FIG. 10 is a plan view of the metal encasement for and alternative embodiment tube plate or tube.
Figure 11:
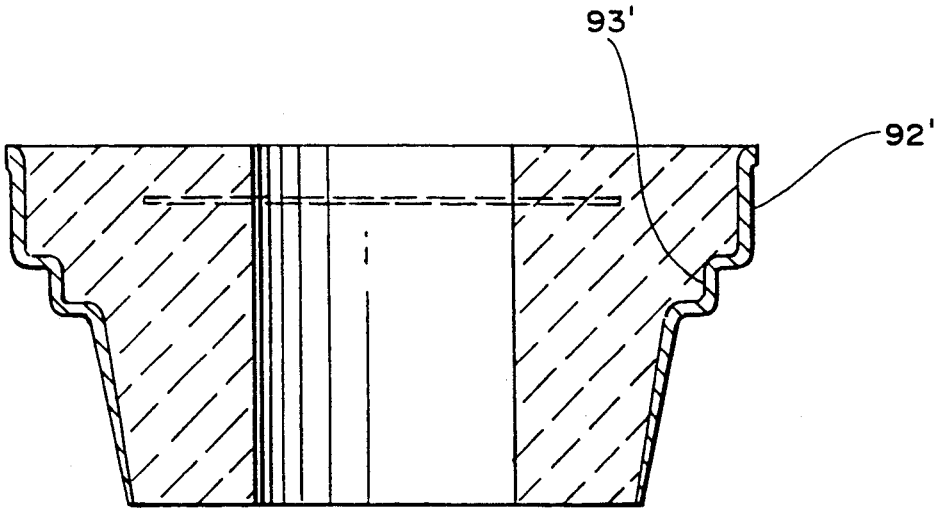
FIG. 11 is a transverse sectional view of the tube plate taken along section line 11—11 of FIG. 10 but showing the refractory in place.

An alternative embodiment tube plate 21' is shown in FIGS. 10 and 11. There it will be seen that the metal frame 92' as shown in FIG. 10 contains a modified anti-reversal enlargement 93', which enlargement is in the form of a boss as distinguished from a collar. In the cross-sectional embodiment shown in FIG. 11, it will be seen that the refractory is shown in place, and the extensions 92' engaging the refractory.

The method of the present invention contemplates the use of a plate changer in which the changer has loading rails, and then proportioning the plate and its depending tube with an enlarged encasement member beneath the plate. Additionally, in certain adaptations, the length/width relationship between the loading axis and the axis perpendicular thereto exceeds seven millimeters, the rectangular shape in conjunction with the guide rails as well as the rocker arms will preclude the insertion of an improperly oriented plate.

Existing plate changers such as the one disclosed in U.S. Pat. No. 4,669,528 utilize auxiliary appendages welded to the bottom of the plate encasement to provide anti-reversing capability. The anti-reversal enlargement 93 as disclosed here becomes an integral part of the plate and performs the function of keying against non-reversibility without additional cost or operations involved in securing separate anti-reversal devices as a retrofit or separate part of the new product.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A plate changer having a plate change actuator, said plate change actuator being employed in conjunction with plates which are sequentially conveyed through the device, each plate having a length and width, said plates requiring specific orientation to be inserted into the plate changer along an axis of insertion parallel with the length of the plate, said plate change actuator comprising, an actuator mounting arm, an actuator mounting arm pivot, a pusher secured to said actuating arm, a link connection comprising an anchor link, drag link, and link pivot, said links being oriented and proportioned to mechanically lock the plate change actuator by means of a toggle action when the ready plate is in the ready position and properly oriented with its length parallel to the axis of insertion.

2. In the plate changer of claim 1, a hydraulic cylinder secured to the plate change actuator through the link connection and drag link.

3. In the plate changer of claim 1, a pneumatic cylinder secured to the plate change actuator.

4. In the plate changer of claim 1, a solenoid secured to the plate change actuator.

5. A plate for use with a plate changer for mounting to a vessel having a means for controlling the flow of molten metal from the vessel and in which at least two plates are in compressive face-to-face relationship, and having a stationary plate communicating to said means for controlling the flow of molten metal, means to sequentially convey a plate through the plate change along an axis of insertion, said plate changer having means for moving a pusher in the loading area to load plates into the plate changer, a plate having an upstream face portion, said plate having a downstream portion of reduced dimensions to accommodate loading apparatus and pressure sealing apparatus, lateral edges between the upstream and downstream portions of the plate, said upstream face portion having a substantially rectangular plan view, the length of said face being parallel to the axis of insertion and the width being perpendicular to the length, said face portion having a width greater than length by at least seven millimeters.

6. In the plate of claim 5, a metal encasement for the downstream portion of the reduced dimension portion.

7. In the plate of claim 5, said plate having a depending pour tube.

8. In the plate of claim 5, said plate and a depending pour tube being a unitized refractory body .

9. In the plate of claim 7, said depending pour tube being submersible.

10. In the plate of claim 5, means for securing a depending pour tube.

11. A plate for use in a plate changer in which said plate is in compressive face-to-face relationship with a stationary plate, and in which plates are sequentially conveyed through the plate changer, said plate changer being positioned for use in conjunction with a flow control apparatus on a vessel, said plate changer utilizing a mechanism to move a pusher for positioning on the mechanism to change, said plates guided by rails along a change axis comprising, an upstream face portion, a downstream plate portion of reduced size, lateral edges between said upstream and downstream portions, said downstream portion being enlarged along the axis parallel to the plate change axis sufficiently to prevent reversal when moving on the rails being spaced to receive the downstream portion only when the plate is properly oriented.

12. In the plate of claim 11, a metal encasement for said plate edges.

13. In the plate of claim 11, means for securing a pour tube.

14. In the plate of claim 11, said plate and depending pour tube being a unitized refractory body.

15. In the plate of claim 11, wherein said downstream portion is oval in configuration.

16. In the plate of claim 11, wherein said downstream portion is elliptical in configuration.

17. In the plate of claim 11, said downstream portion being substantially rectangular.

18. The method for preventing a sequential sliding plate reversal in a plate change having a flow control mechanism positioned upstream from the plate changer involving the steps of:

form the shape of a plate to have an upstream and downstream portion with one major dimension of its downstream portion at least seven millimeters greater than the other, form the shape of the apparatus to have a receiving opening complementary with that of the lesser dimension, whereby upon reversal of the plate of the improper orientation it cannot be positioned interiorly of the plate changer.

19. In the method of claim 18, forming the upstream and downstream portions to have an asymmetrical profile, forming the apparatus to have a receiving opening to receive a properly oriented asymmetrical profile.

20. The method for preventing a plate reversal in a plate changer downstream of a flow control mechanism comprising the steps of:

shaping the plate to have an asymmetrical profile, shaping the changer to have a receiving opening for the asymmetrical profile and pre-oriented to receive only a properly oriented plate.

21. In the plate of claim 5, a metal encasement for the lateral edges of said plate.

22. A tube plate for use in a plate changer in which said tube plate is in compressive face-to-face relationship with a stationary plate, and in which tube plates are sequentially conveyed through the plate changer, said plate changer being positioned for use in conjunction with a flow control apparatus on a vessel, said plate changer utilizing a mechanism to move a pusher for position on the mechanism to change, said tube plates guided by rails along a change axis comprising, an upstream face portion of the tube plate, an anti-reversal enlargement collar downstream of the upstream face portion of the tube plate, said collar being asymmetrical and larger than the rails along an axis perpendicular to the change axis, whereby the plate can be loaded for insertion only in the direction of the axis of change.

23. In the plate of claim 22, a metal encasement for said plate edges,

24. In the plate of claim 22, means for securing a pour tube.

25. In the plate of claim 22, said plate and depending pour tube being a unitized refractory body.

26. In the plate of claim 22, wherein said downstream portion is oval in configuration.

27. In the plate of claim 22, wherein said downstream portion is elliptical in configuration.

28. In the plate of claim 22, said downstream portion being substantially rectangular.

* * * * *